US006655031B1

(12) United States Patent
Grant et al.

(10) Patent No.: US 6,655,031 B1
(45) Date of Patent: Dec. 2, 2003

(54) WICK CUTTING DEVICE

(75) Inventors: Dianna Grant, 210 Laurel St., Lakewood, NY (US) 14750; Robert Levin, Lakewood, NY (US); Darlene Levin, Jamestown, NY (US)

(73) Assignee: Dianna Grant, Lakewood, NY (US)

( * ) Notice: Subject to any disclaimer, the term of this patent is extended or adjusted under 35 U.S.C. 154(b) by 0 days.

(21) Appl. No.: 09/639,402

(22) Filed: Aug. 15, 2000

(51) Int. Cl.[7] ..... B26B 13/00
(52) U.S. Cl. ..... 30/125; 30/240; 30/279.2
(58) Field of Search ..... 30/125, 240, 263, 30/276, 279.2, 312, 495, 29.5, 109

(56) References Cited

U.S. PATENT DOCUMENTS 853,832 A * 5/1907 Ryan ..... 30/240
2,894,324 A * 7/1959 Hardin ..... 30/240
4,844,064 A * 7/1989 Thimsen et al. ..... 30/240
4,850,354 A * 7/1989 McGurk-Burleson et al. 30/240
4,914,818 A * 4/1990 Hall et al. ..... 30/90.1
6,209,207 B1 * 4/2001 Patterson et al. ..... 30/125

* cited by examiner

*Primary Examiner*—Boyer Ashley
*Assistant Examiner*—Thomas J Druan, Jr.
(74) *Attorney, Agent, or Firm*—Simpson & Simpson, PLLC

(57) ABSTRACT

The present invention describes a wick cutting device, particulary designed to clip the wicks of candles to a specified length. The invention comprises two cylinders, one with a grip and one with a handle. The wick trimmer is assembled as a cylinder inside a cylinder in which the inner cylinder has a steel blade at the bottom. The inner cylinder rotates within the outer cylinder. The wick is cut with a simple twist of the handle.

6 Claims, 7 Drawing Sheets

WICK CUTTING DEVICE

FIELD OF THE INVENTION

The subject of the invention relates to a cutting device, and relates more particularly to a wick trimmer for candles.

DESCRIPTION OF THE RELATED ART

Before the advent of electricity, candles, oil and gas lamps provided all necessary illumination in houses and streets. Once modern electricity was accessible, the development of other types of lighting devices increased and use of candles as a primary source of illumination decreased. Candles became primarily an emergency item to be used in case a power outage took place. In recent history, the interest in candles and candle burning has increased. The practice of burning and using candles has increased due to a climbing interest in relaxation and aromatherapy and the beauty of candles in general. Evidence of this trend can be found in the tremendous variety of candles now offered on the market. In addition, magazines have also increased the advertisement of various types of candles and uses of candles for home decoration. The making of candles has also become a popular hobby.

The wick is an important component of a candle or an oil lamp. The wick is delivers the fuel to the flame that will keep the candle or oil lamp burning. Wicks are usually made of cotton fibers woven very compactly. Early candles used plain cotton wicks. The wicks in these early candles needed to be trimmed as the wax burned down. Most of the modern commercial candles have wicks to which chemicals have been added. The chemicals added to the wick allows the wicks to burn along with the wax. In some cases, the wick is plaited such that the tip will curl over into the hottest part of the flame. The high heat then burns the tip of the wick off. In theory, this design will keep the wick at the right length for optimal burning. Unfortunately, not all commercial candles have the ideal length for a wick when first purchased. In addition, there is a great variety in the quality of the candle and wicks available. Further, if candles are made by a hobbist, proper tools are required to cut the wick of the candle to the right length.

The trimming of the wick is an important step in the making and maintenance of candles. If the wick of a candle is too long the flame will be very large, burning the wax away very quickly. This shortens the useable lifetime of the candle. If the wick is too short for the candle, excessive smoking can occur. The tools for trimming wicks are as old or older than candles. In antique shops, many examples of wick trimmers can be found. Most of these early wick trimmers are shaped like scissors. A disadvantage of the scissors-like design is that the scissors-like design cannot fit within the modern containers for candles.

U.S. Design Pat. No. D 422,470 illustrates a modern candlewick cutter that is shaped like a pair of scissors. There are disadvantages to this design. For instance, the scissors-like design does not cut to a specified length on a consistent basis. In addition, the scissors-like design does not fit into some designs of candle holders. If candle production is occurring at home, it is difficult, with the scissors-like design, to assure all the candles will have the same wick length once the wick is inserted in the candle. Another disadvantage of the scissors like design is the difficulty of use if an injury or a limitation of the hand (such as arthritis) is present. The scissors-like design will also requires modification for a left or a right handed person and, thus, is not universal to all users.

SUMMARY OF THE INVENTION

The present invention seeks to overcome the above mentioned limitations of the prior art. The present invention describes a wick cutting device, particulary designed to clip the wicks of candles to a specified length. The invention comprises two cylinders, one with a grip and one with a handle. The wick trimmer is assembled as a cylinder inside a cylinder in which the inner cylinder has a steel blade at the bottom. The inner cylinder rotates within the outer cylinder. The wick is cut with a simple twist of the handle. Accordingly, an object of the invention is to provide a wick trimmer that will consistently cut the wick to the same length. A recessed blade of hardened steel or any other appropriate material decides the length of the wick. Also, the design of the present invention will allow trimming of wicks in hard to reach places, such as a tall glass container in which a small candle is burning.

The invention comprises a first hollow cylinder and a second cylinder. The second cyliner possesses a recessed blade at one end of the cylinder. The second cylinder is placed within the first cylinder. The cutting device is then placed over the wick and second cylinder is twisted. The twist of the second cylinder will result in the cutting of the wick at the specified length. Due to the design, the wick cutting device will fit inside most commercially designed candle holders and trims hard to reach wicks. Another object of the invention is to create a wick trimmer which has ease of application for either a left or right handed user. Also, the invention will allow ease of use in case of hand limitations such as arthritis. Finally the risk of injury on this design is minimal in comparison with the scissors like design. The blade in the invention is recessed lowering the possibility of an accidental cut. These above mentioned characteristics and other objects of the invention will become more apparent from the following description of the preferred embodiments.

OBJECTS OF THE INVENTION

Accordingly, it is an object of the present invention to provide a cutting device that allows access to hard to reach wicks of candles and to fit within modern designs of candle holders.

It is also an object of the present invention to provide a cutting device that cuts a wick to a specific length consistently.

It is a further object of the present invention to provide a universal cutting device that will operate easily for all types of users, including but not limited to, right and left hand users and users with arthritis.

BRIEF DESCRIPTION OF THE DRAWINGS

Other aspects, objects, and advantages of the present invention appear more clearly on reading the following best mode for carrying out the invention, given by way of example and made with reference to the accompanying drawings, in which.

BEST MODE FOR CARRYING OUT THE INVENTION

Figure 1A:
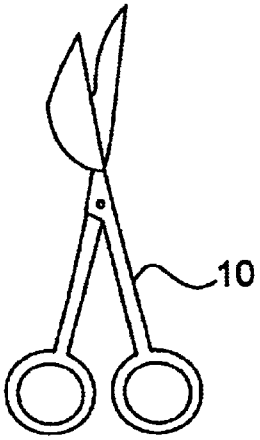
Fig. 1A Prior Art
FIGS. 1*a* and 1*b* illustrate prior art designs of wick cutters.

The drawings will be described in detail. For the ease of the reader reference numerals designating identical or similar parts will remain consistent throughout the drawings.

Figure 1B:
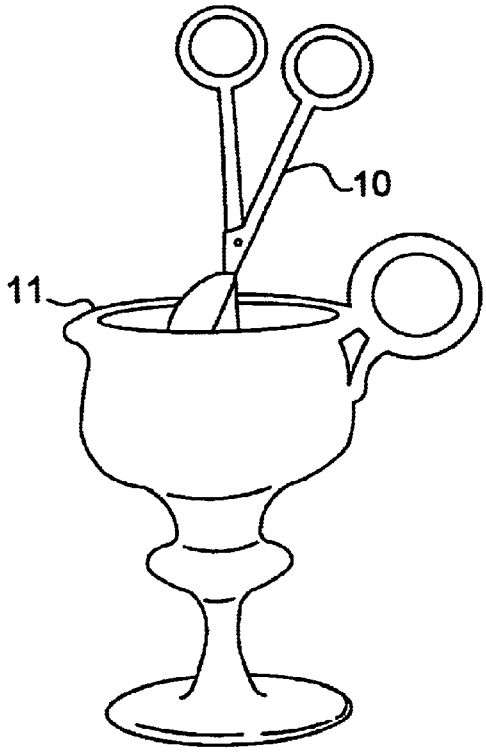
Fig. 1B Prior Art

FIGS. 1A and 1B show views of a prior art wick trimmer. FIG. 1A shows the wick trimmer 10, which is an early American antique made of wrought iron. In FIG. 1B the wick trimmer 10 is placed in base 11. The base 11 is made to complement candlesticks of the period. It can be appreciated that the wick trimmer 10 is shaped like a scissors.

Figure 2:
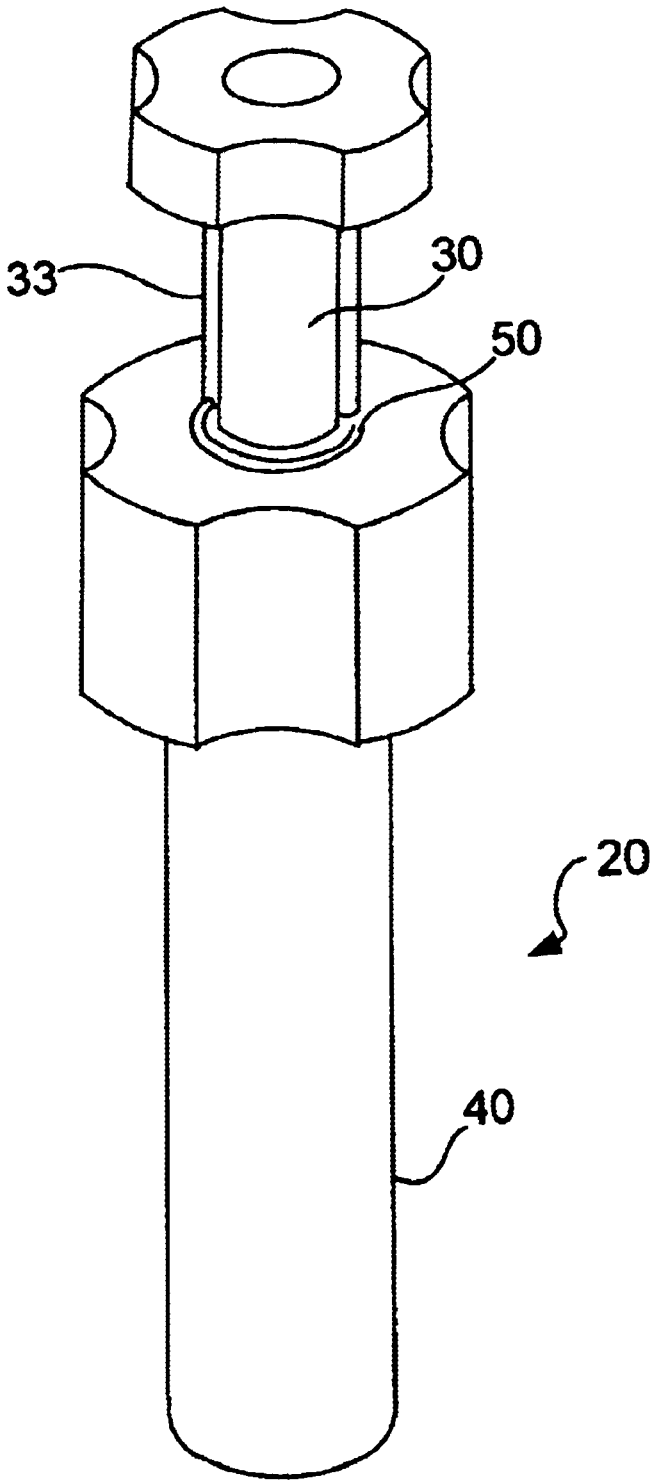
FIG. 2 depicts a three dimensional front view of the present invention.

FIG. 2 shows a three dimensional front view of the wick cutter 20 featured in the invention. The wick trimmer 20 is made of injection molded plastic with a hardened steel blade. It should be noted that the wick cutting device can be made of other various sturdy materials. The wick trimmer 20 is composed of two parts, a hollow outer cylinder 40 and an inner cylinder 48 that can be inserted inside the outer cylinder 40. The outside cylinder 40 is shorter in length than the inner cylinder 48. The outer cylinder 40 has a grip 70 which is shaped like a gearwheel. The outer cylinder 40 has a groove 50 in the top of the cylinder. The basic design of the wick cutting device is a tube inside a tube. The inner cylinder 48 has a handle 60 at the top, also shaped like a gearwheel. A groove 50 is cut in the grip 70 of the outer cylinder 40 in the shape of a letter C, and is adapted to receive hanging wall 33 which extends from handle 60 in which part of the inner cylinder 48 sits.

Figure 3:
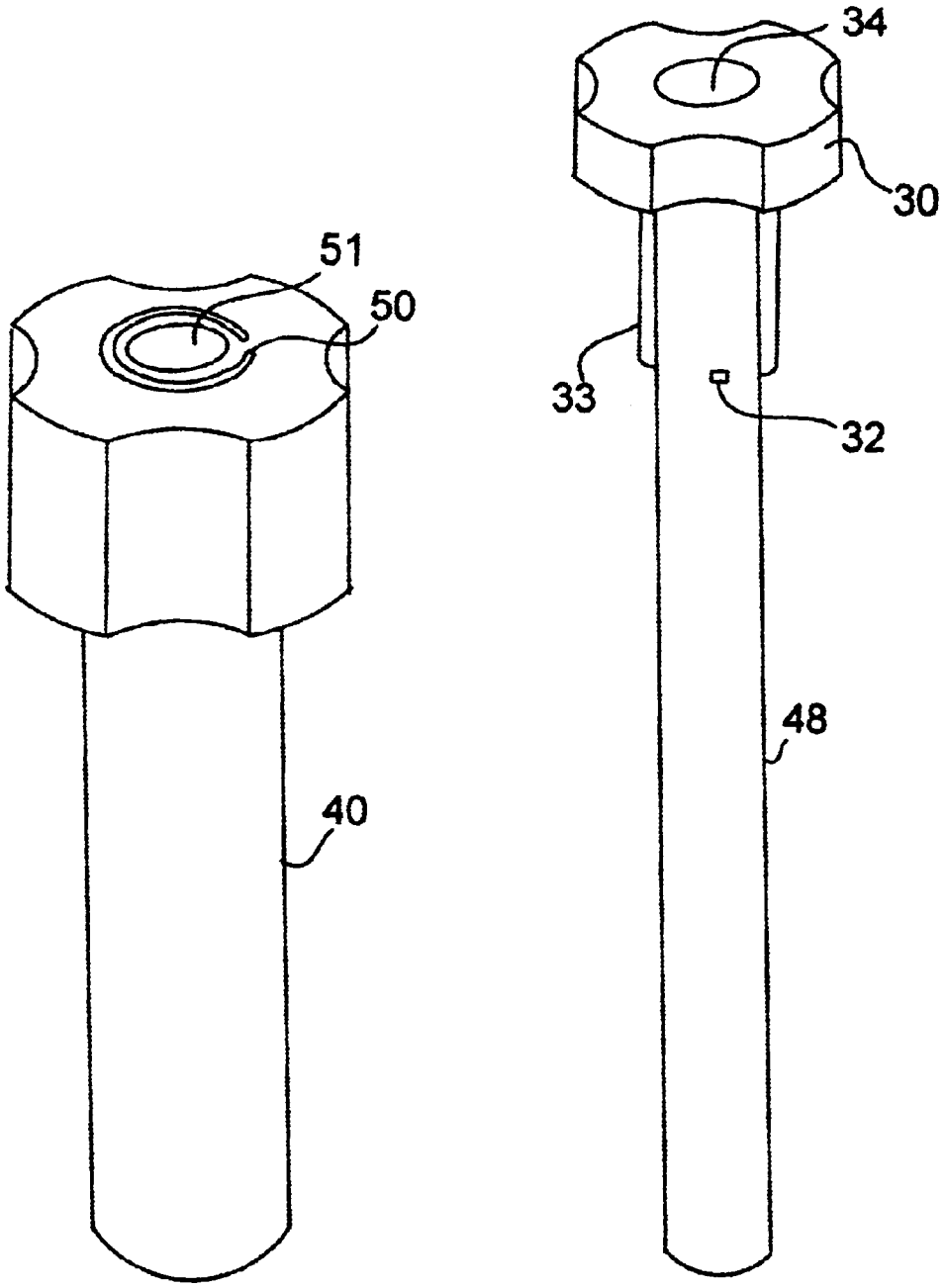
FIG. 3 shows three-dimensional front views of the separate components of the present invention.

FIG. 3 shows a three-dimensional front view of the hollow cylinders taken apart. The outer cylinder 40 is shorter than the inner cylinder 48. The outer cylinder 40 is approximately 15 cm and the inner cylinder 48 is approximately 17 cm. The groove 50 can be seen surrounding the hole 51 in which the inner cylinder 48 is inserted. The groove 50 is shaped like a letter C. Details of the inner cylinder [30] 48 can be observed in the figure. The tube (or cylinder) 48 is inserted inside the hole 51 of the outer cylinder 40. The tube 48 has a pin 32 sticking from the side, this pin 32 fits inside an inner groove or channel 52 in the inside wall of the outer cylinder 40. When the tube 48 is inserted into the outer cylinder, the pin 32 sits on the inner groove 52. During manufacture, inner cylinder 48 is forced into outer cylinder 40 until pin 32 sits in inner groove 52 by using a suitable press or similar device capable of applying pressure to a workpiece. Such press devices are well known to those skilled in the art. This locks the tubes together, allowing free rotational movement of the inner tube 48 inside the outer cylinder 40. It can also be noted in the drawing the semicircular hanging wall 33 from the top handle. In the most preferred embodiment, the hanging wall 33 is approximately 2 cm long. This hanging wall 33 is inserted in the groove 50. The groove provides the range of twisting allowed for the inner cylinder 48. The inner tube 48 contains the blade 35 that will cut the wick. The cut wick can be removed by the hole 34 in the inner cylinder 48.

Figure 4:
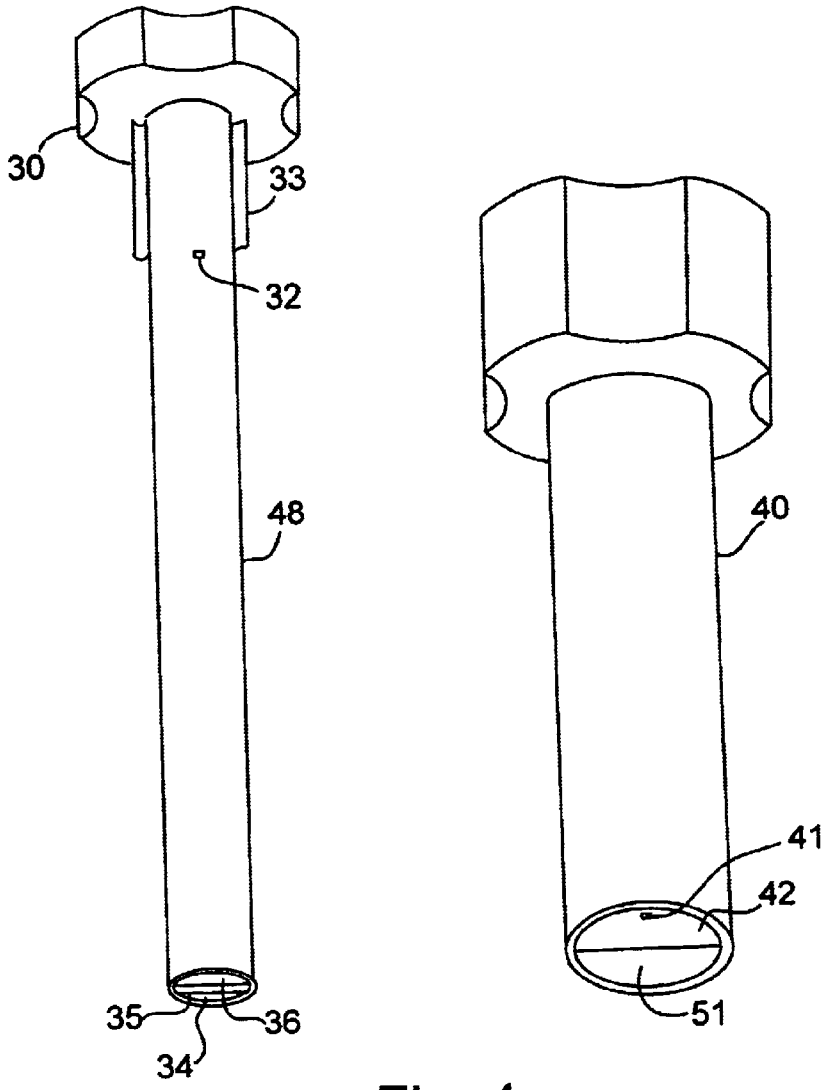
FIG. 4 shows a three dimensional bottom view of the separate components of the present invention.

FIG. 4 shows a three-dimensional bottom view of the hollow cylinders taken apart. Pin 32 and the semicircular hanging wall 33 can be seen. The outer diameter of outer cylinder 40 is approximately 2.5 cm; the inner diameter of outer cylinder 40 is approximately 1.8 cm. In the most preferred embodiment, the outer diameter of inner cylinder 48 is approximately 1.7 cm and the inner diameter is 1.2 cm. At the bottom of inner cylinder 48, blade 35 can be seen. Blade 35 is attached to plastic section 36, covering at least half of hole 34 and forming aperture 51 when inner cylinder 48 is placed inside outer cylinder 40. In a most preferred embodiment, blade 35 is made of hardened steel and is flush with the end of inner cylinder 48 opposite handle 60. It will be understood by one skilled in the art that a wick cutting device can be made of different colors, including but not limited to, gold, silver, and black. At the bottom of outer or first cylinder 40, semicircular plastic cover 42 covers half of aperture 51. Plastic cover 42 is attached by pin 41 to outer cylinder 40. Plastic cover 42 is fixedly secured to the outer or first cylinder 40. In a most preferred embodiment, plastic cover 42 is recessed approximately 0.64 cm (¼ inch) allowing the trimming of the wick to the length recommended most often by the candle industry. In an alternative embodiment, plastic cover 42 can be removably secured to outer or first cylinder 40.

Figure 5A:
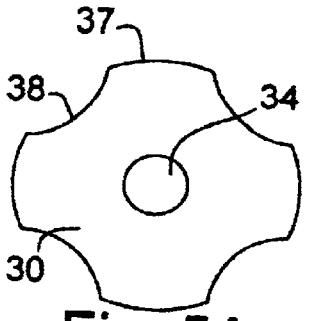
FIGS. 5 A, B, C, D, and E show cross sectional views of the separate components of the present invention.
Figure 5B:
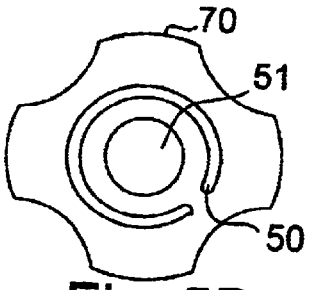
Figure 5C:
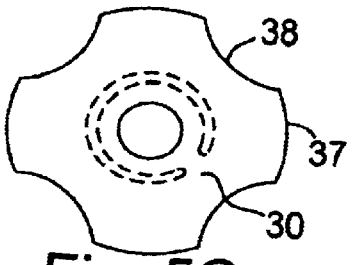
Figure 5D:
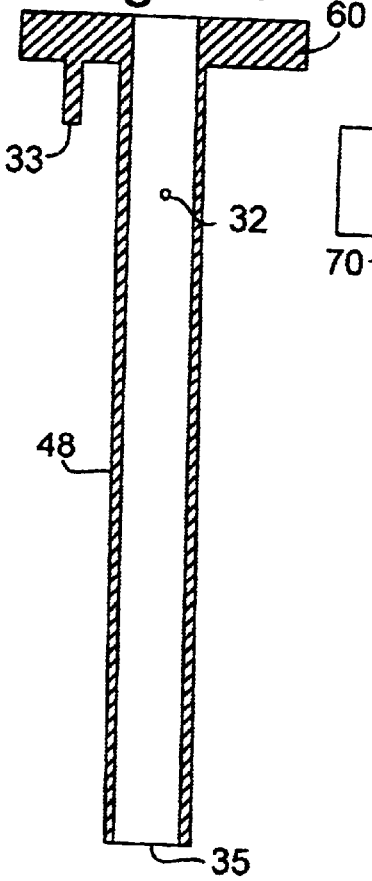
Figure 5E:
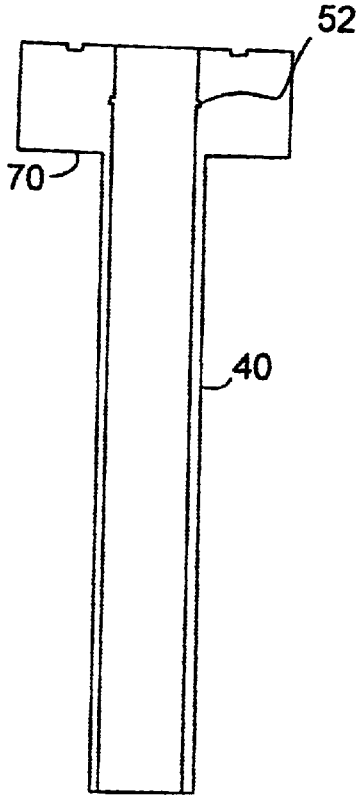

FIGS. 5A, 5B, 5C, 5D and 5E show cross sectional and top views of the wick trimmer components. FIG. 5A shows a top view of the gear wheel handle 60 which is attached to the inner cylinder 48. The hole 34 can be seen and is crossed by the pin 32. The gear wheel is smooth, with soft indentations 38 and teeth 37. The indentations 38 allow for a comfortable fit of the fingers of the hand when holding the wick cutter. FIG. 5B shows a top view of the outer cylinder 40. The outer groove 50 in the top of the grip 70 can be observed. In a most preferred embodiment, the grip 70 of the outer cylinder 40 has a height of approximately 3.8 cm as compared to the 1.3 cm height of the handle in the inner cylinder 48. Also in the most preferred embodiment, the diameter of both handles is exactly the same, such that when one observes the wick trimmer from the top only one gear wheel can be seen, as shown in FIG. 5C. FIG. 5D shows a cross sectional view of the inner cylinder 48. The pin 32 is located on the body of the inside cylinder 48 such that it will mate with the inner groove 52 of the outer cylinder, as shown in FIG. 5E. In addition, FIGS. 5D and 5E depict the other mating components such as the semicircular hanging wall 33 and the C-shaped groove 50.

Figure 6:
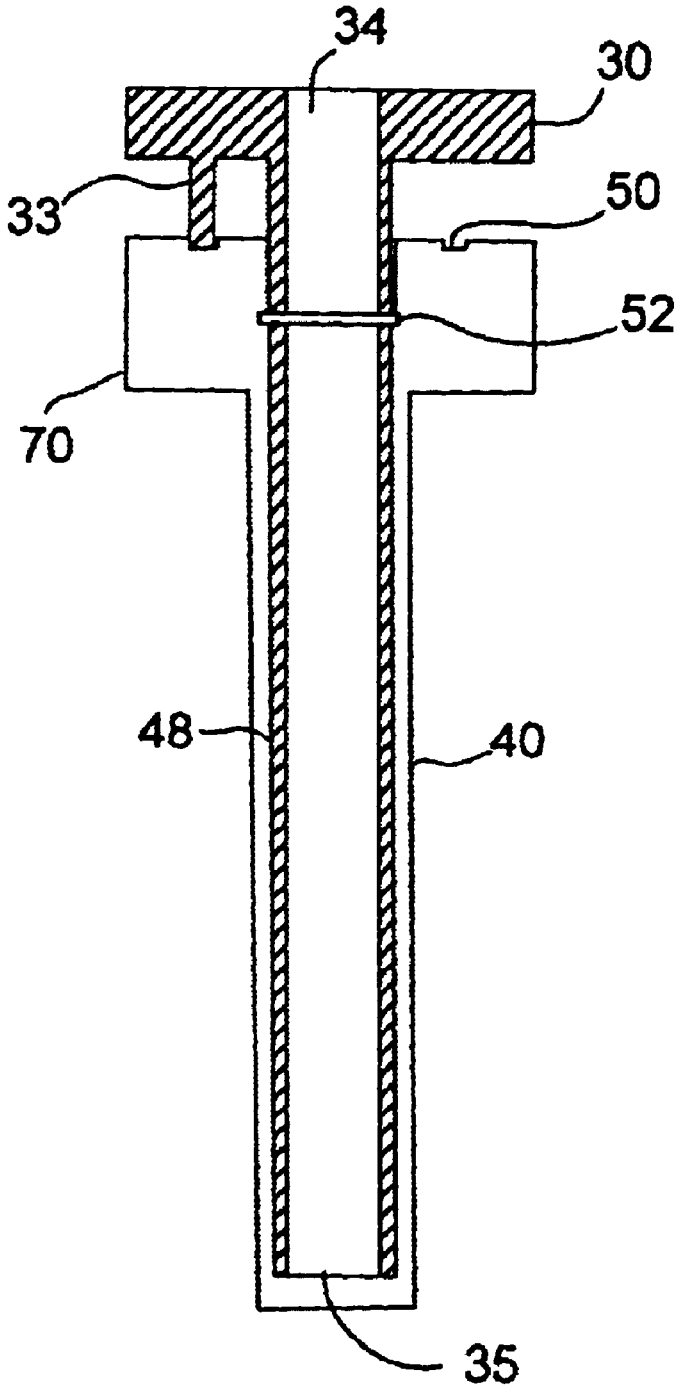
FIG. 6 depicts a cross sectional view of the invention, as assembled.

FIG. 6 shows cross sections of the assembled wick trimmer. FIG. 6 depicts how pin 32 goes through the hole 34 and sits in the inner groove 52. The semicircle hanging wall 33 is shown sitting in the outside groove 50. Also the space 43 between the bottoms of the inner and outer cylinder can be noted. This space allows to recede the blade 0.64 cm (or ¼ inch), the recommended length for candle wicks.

Figure 7:
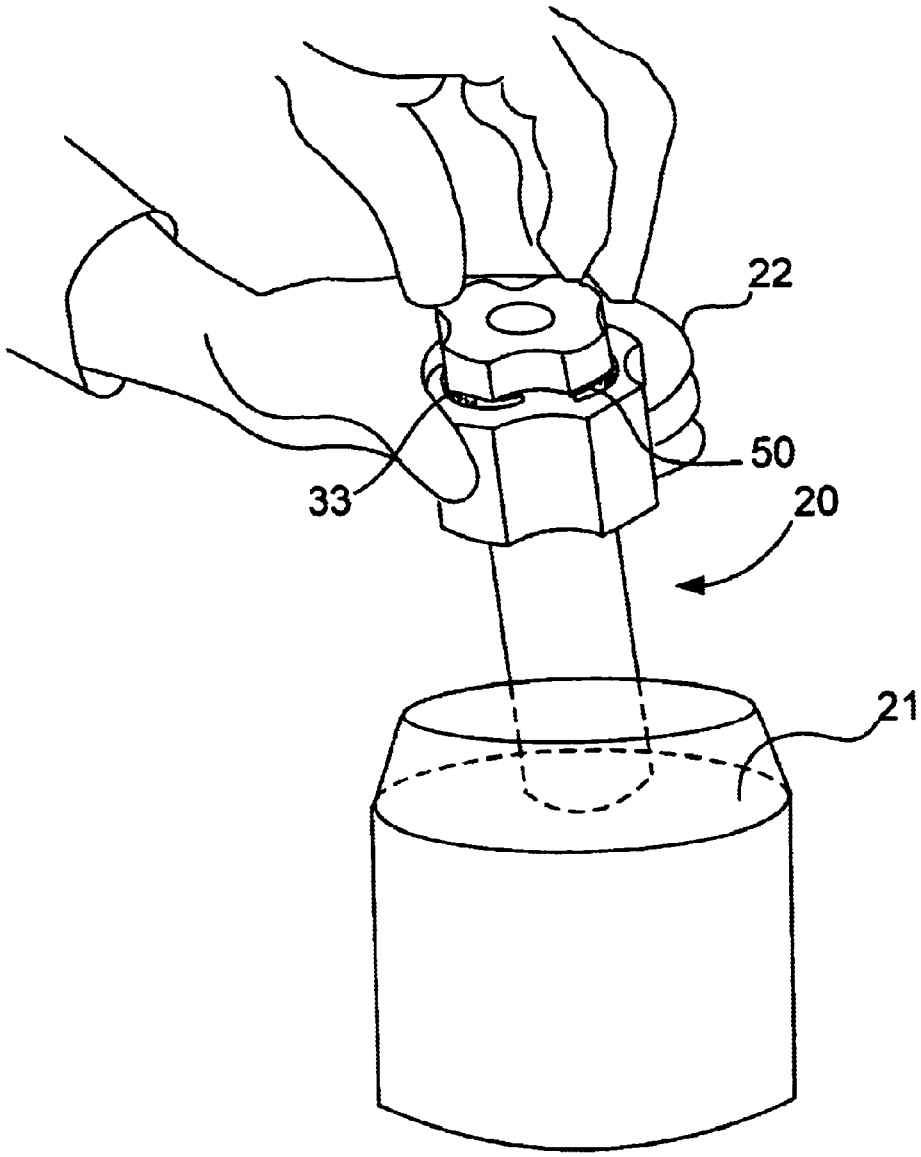
FIG. 7 illustrates how the present invention is used.

FIG. 7 shows wick trimmer 20 in use. The cylinders forming the wick trimmer 20 are rotated into a position that creates a half circle aperture (as shown in FIG. 4 by aligning the blade 35 over the recessed plastic cover 42. Wick trimmer 20 is put at the top of candle 21 allowing for the introduction of the candle wick (not shown) into aperture 51 (not shown). As mentioned supra, plastic cover 42 is recessed allowing for the recommended length of wick to remain on the candle. One hand 22 holds the outer cylinder 40 by the grip 70 while the other hand twists the handle 30 of the inner cylinder 48. The twisting motion causes blade 35 to push the wick against the plastic cover 42. The groove 50 in combination with wall 33 controls the amount of rotation by limiting over-rotation or twisting of the inner cylinder 48. The wick is then cut by blade 35 to the desired length using plastic cover 42 to hold the wick while it is being cut. Once cut, the sheared wick is captured on the inside of recessed plastic cover 42, lifted from the candle and later removed from the inside of the inner cylinder 48. Alternatively, the cut wick may be lifted from the top of candle 21.

The description presented in the preferred embodiments of a wick trimmer made of injection molded plastic with a recessed blade of hardened steel is not intended to demonstrate all the possible arrangements and modifications to design. For those skilled in the art changes will be suggested in the within the scope of the present invention.

What is claimed is:

1. A device for cutting a wick of a candle, comprising:

a first cylinder, said first cylinder being hollow and having a first end and a second end and incorporating a first groove enclosed by an inner circular wall of the first cylinder;

a grip positioned on the outer surface of said first cylinder, said grip having a top end and a bottom end and having a diameter substantially greater than the diameter of said first cylinder, the top end of said grip defining a second groove;

a cover secured to said second end of said first cylinder, said cover partially concealing said second end of said first cylinder;

a second cylinder, said second cylinder being hollow and having a first end and a second end, said second cylinder fitting within said first cylinder such that said second cylinder rotates within and frictionally engages said first cylinder;

a handle positioned at said first end of said second cylinder, said handle having a top end and a bottom end and operatively arranged to rotate said second cylinder;

a hanging wall extending from said bottom end of said handle, said hanging wall positioned between the perimeter of said handle and a circular wall of said second cylinder and engaging said second groove in such a way as to restrict the rotation of said second cylinder;

a recessed semicircular blade secured to said second end of said second cylinder; and, a pin extending from said circular wall of said second cylinder said pin operatively engaged with said first groove.

2. The wick-cutting device according to claim 1 wherein said handle is gear-shaped.

3. The wick-cutting device according to claim 1 wherein said grip is gear-shaped.

4. The wick-cutting device according to claim 1 wherein said cover is recessed about ¼ inch from said second end of said first cylinder.

5. The wick-cutting device according to claim 1 wherein said second groove is C-shaped.

6. The wick cutting device according to claim 1 wherein said blade is flush-mounted to said second end of said second cylinder.

* * * * *